US006315552B1

(12) United States Patent
Haynes et al.

(10) Patent No.: US 6,315,552 B1
(45) Date of Patent: Nov. 13, 2001

(54) DUAL FUEL CIRCUIT GAS BURNER

(75) Inventors: Joel Meier Haynes, Niskayuna, NY (US); Victor Caloca; Jeronimo Ramirez, both of Queretaro (MX)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/539,341

(22) Filed: Mar. 31, 2000

(51) Int. Cl.[7] ..... F23D 14/06; F23D 14/70

(52) U.S. Cl. ..... 431/285; 431/278; 431/354; 239/553.3; 239/553; 239/567; 239/568

(58) Field of Search ..... 431/278, 284, 431/285, 8, 354; 239/568, 555, 559, 567, 553, 553.3, 553.5, 552, 549

(56) References Cited

U.S. PATENT DOCUMENTS

| | | | | |
|---|---|---|---|---|
| 1,923,393 | * | 8/1933 | Pickup | 431/284 |
| 5,488,942 | | 2/1996 | Maughan | 126/39 E |
| 5,899,681 | | 5/1999 | Maughan | 431/8 |

FOREIGN PATENT DOCUMENTS

| | | | | |
|---|---|---|---|---|
| 0719982-A | * | 12/1995 | (EP) . | |
| 633234 | * | 6/1927 | (FR) | 126/39 H |
| 631072 | * | 12/1927 | (FR) | 431/284 |
| 481578 | * | 6/1936 | (GB) | 126/39 E |
| 0370326 | * | 10/1974 | (GB) | 431/284 |
| 11-223310 | * | 8/1990 | (JP) | 431/284 |

* cited by examiner

*Primary Examiner*—Carl D. Price
(74) *Attorney, Agent, or Firm*—Patrick K. Patnode; Christian G. Cabou

(57) ABSTRACT

Increased turndown ratio is achieved by providing an atmospheric gas burner having a burner body with a plurality of ports formed therein and a fuel flow divider disposed in the burner body. The fuel flow divider defines a primary fuel chamber and at least one secondary fuel chamber, wherein the secondary fuel chamber is in fluid communication with at least one of the ports and the primary fuel chamber is in fluid communication with the remaining ports. A first mixing tube introduces a fuel-air mixture into the primary fuel chamber, and a second mixing tube introduces a fuel-air mixture into the secondary fuel chamber.

7 Claims, 4 Drawing Sheets

DUAL FUEL CIRCUIT GAS BURNER

BACKGROUND OF THE INVENTION

This invention relates generally to atmospheric gas burners and more particularly to such burners used in domestic cooking appliances.

Atmospheric gas burners are commonly used as surface units in household gas cooking appliances. Conventional gas burners ordinarily comprise a cylindrical head having a number of ports formed around its outer circumference. A mixer tube introduces a mixture of fuel and air into the burner head. The fuel-air mixture is discharged through the ports and ignited to produce a flame. A significant factor in the performance of gas burners in general is a burner's operating range as measured by the turndown ratio (i.e., the ratio of the maximum fuel input rate to the minimum fuel input rate that will support a stable flame). Operating range is particularly important for gas burners used in gas cooking appliances because such burners are often required to operate over a wide range of inputs.

A burner's turndown ratio is limited by the minimum gas velocity at the burner ports that will support a stable flame. When fuel input is reduced for simmer operation, the gas velocity through the ports becomes lower. Eventually, the gas velocity can become so low as to result in no flame at all or a marginal flame that is prone to being extinguished by disturbances in the surroundings, such as room drafts or oven door slams. The problem is particularly evident in the so-called sealed gas burner arrangements, i.e., burner arrangements lacking an opening in the cooktop surface around the base of the burner to prevent spills from entering the area beneath the cooktop, thereby facilitating easier cleaning of the appliance. Generally, the turndown ratio for such burners with one fuel stream is limited to about 13:1.

One known burner that provides an increased turndown ratio is the dual fuel stream burner, which incorporates two separate burner bodies having individual fuel inputs. Such burners have a central burner body, which is much like a smaller version of a standard cylindrical burner head, encircled by a separate annular burner body having a larger diameter. However, the central burner body does not experience as much external air flow because it is completely surrounded by the outer burner body. Thus, less secondary combustion air is available, and the heat output of the burner is reduced. Other drawbacks of such "dual ring" burners are that they are more difficult to clean and are generally more costly than single body burners.

Accordingly, there is a need for a single body atmospheric gas burner that provides increased turndown ratio.

SUMMARY OF THE INVENTION

The above-mentioned need is met by the present invention which provides a gas burner having a burner body with a plurality of ports formed therein and a fuel flow divider disposed in the burner body. The fuel flow divider defines a primary fuel chamber and at least one secondary fuel chamber, wherein the secondary fuel chamber is in fluid communication with at least one of the ports and the primary fuel chamber is in fluid communication with the remaining ports. A first mixing tube introduces a fuel-air mixture into the primary fuel chamber, and a second mixing tube introduces a fuel-air mixture into the secondary fuel chamber.

The present invention and its advantages over the prior art will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
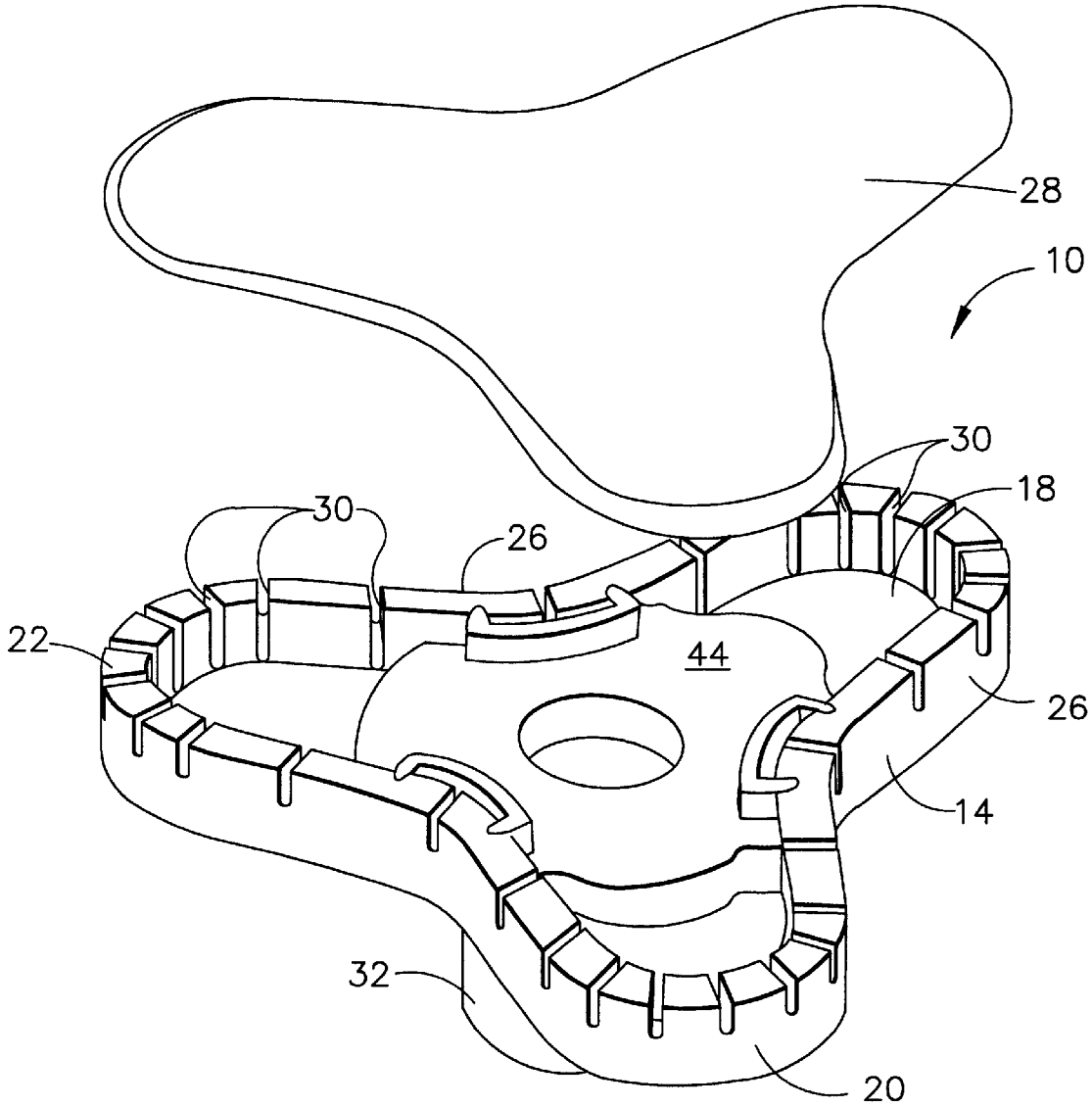
FIG. 1 is an exploded perspective view of an atmospheric gas burner of the present invention.
Figure 2:
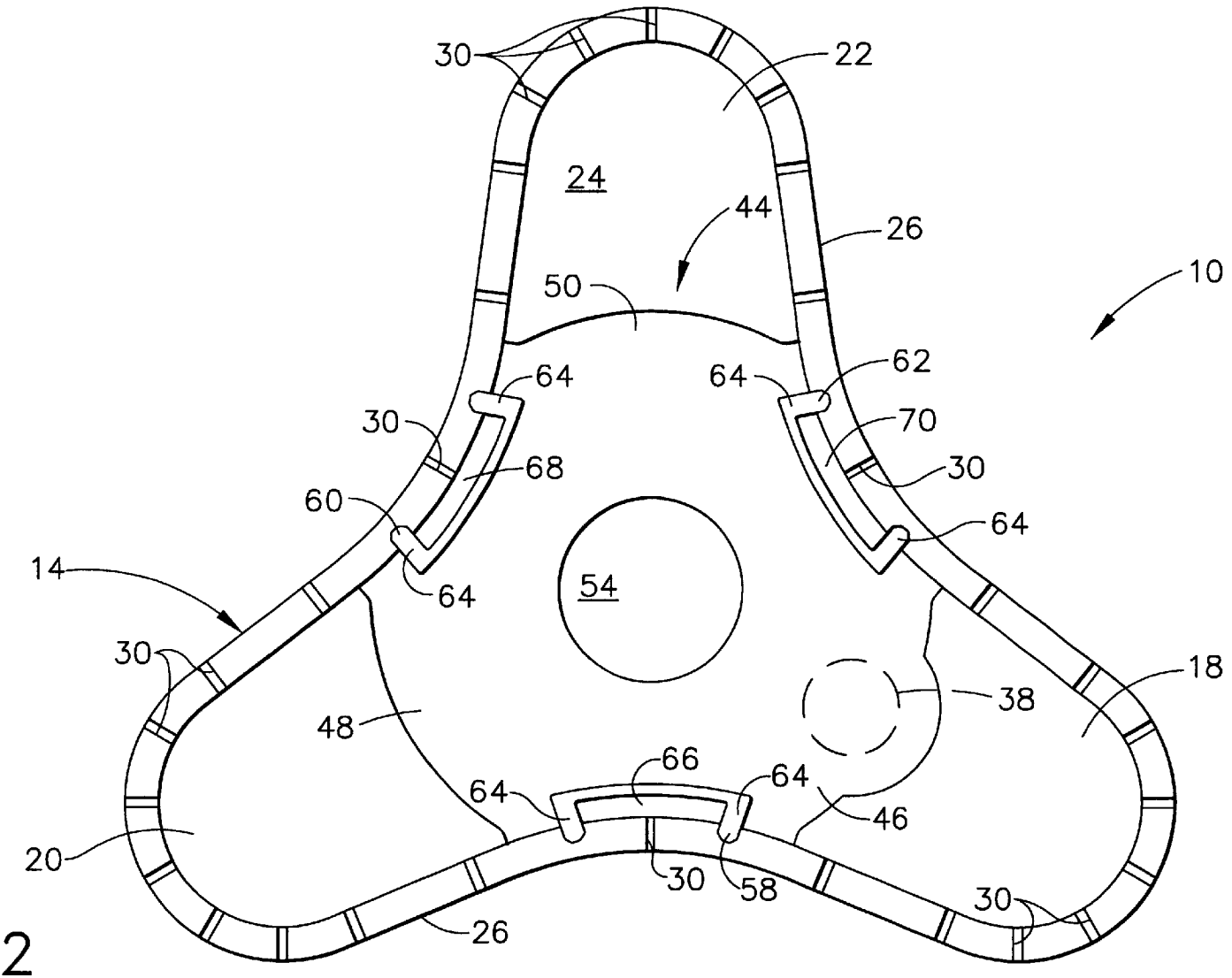
FIG. 2 is a top view of the gas burner of FIG. 1 with its cap removed.
Figure 3:
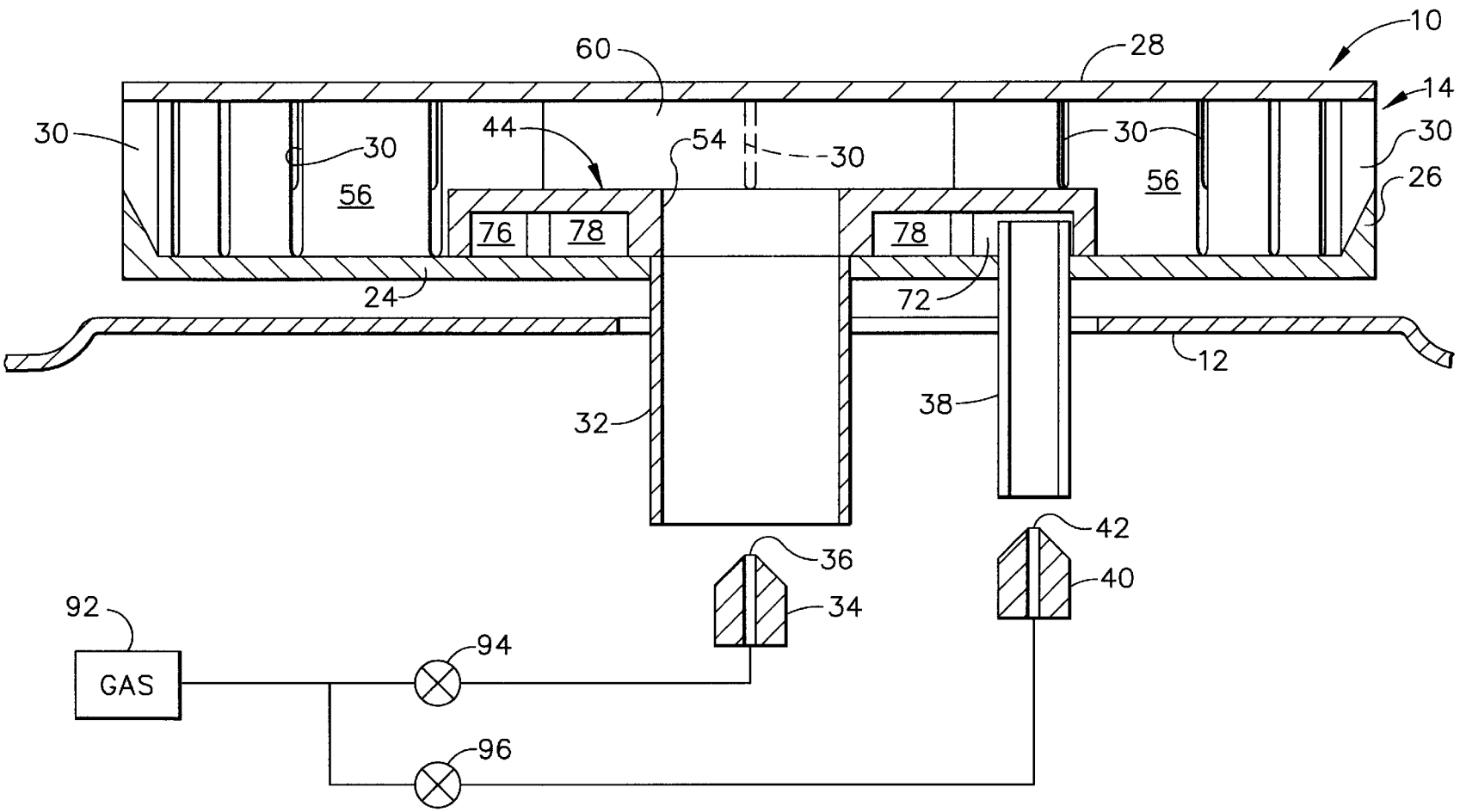
FIG. 3 is a cross-sectional view of the gas burner taken along line 3—3 of FIG. 2.

Referring to the drawings wherein identical reference numerals denote the same elements throughout the various views, FIGS. 1–4 show an atmospheric gas burner 10 of the present invention. The gas burner 10 is located on a support surface 12 that forms a portion of the top side of a gas cooking appliance such as a range or cooktop. As best shown in FIG. 3, the gas burner 10 is arranged as a so-called sealed burner. This means that there is no visible open space in the support surface 12 around the burner 10. The area beneath the support surface is thus sealed off to prevent spills from entering, thereby facilitating cleaning of the coocking surface. However, it should be understood that the present invention is not limited to use in sealed burner appliances, but is equally applicable to other types of gas cooking appliances.

The gas burner 10 comprises a delta-shaped burner body 14 having a center region with first, second and third legs 18,20,22 radiating outward therefrom. While a delta-shaped burner body Is used as an example to facilitate disclosure of the inventive concept of the present invention, it should be recognized that the present invention is not limited to burner bodies having three legs and is applicable to burner bodies having virtually any number of legs as well as circular burner bodies. The burner body 14 includes a delta-shaped base portion 24 and a sidewall 26 formed along the periphery of the base portion 24 and extending perpendicularly therefrom. The burner body 14 may be of any construction, such as an aluminum casting, that is capable of accommodating the types of mechanical stresses, temperatures, and other operating conditions to which the gas burner 10 will be exposed. A delta-shaped cap 28 covers. the top of the burner body 14, so that the cap 28, the base portion 24 and the sidewall 26 define a hollow interior. The cap 28 can either be fixedly attached to the sidewall 26 or can simply rest on the sidewall 26 for easy removal.

A plurality of burner ports 30 is formed in the outer edge of the sidewall 26 so as to be in fluid communication with the burner's hollow interior. As used herein, the term "port" refers to an aperture of any shape from which a flame can be supported. The burner ports 30 are distributed around the circumference of the sidewall 26 and are typically, although not necessarily, evenly spaced. Generally, the total number of burner ports 30 will be in the range of about 15 to 36, depending on the size and heating requirements of the gas burner 10. Although all of these ports 30 are shown in the Figures as being essentially identical, it should be noted that they may differ in configuration. Furthermore, some of the ports 30 differ in the manner in which they are supplied with fuel, as will be described in detail below.

Although not shown in the drawings, the burner body 14 can also include a plurality of carry over slots formed in the outer edge of the sidewall 26. The carry over slots are relatively shallow slots formed between adjacent ones of the ports 30 to improve the flame retention and stability of the burner 10. These carry over slots are described in more detail in U.S. Pat. No. 5,899,681, issued May 4, 1999 to James R. Maughan.

As seen best in FIG. 3, a primary mixing tube 32, such as a venturi tube, extends axially through the support surface 12 so as to have one end (the inlet end) located externally of the burner body 14, below the support surface 12, and the other end (the delivery end) connected to an opening in the base portion 24 so as to provide an entrance to the interior of the burner body 14. The primary mixing tube 32 is shown to be centered in the center region of the burner body 14, although it can alternatively be located off center as well. A primary fuel nozzle 34 is located approximately concentric with the mixing tube 32 and has an injection orifice 36 aligned with the inlet end of the primary mixing tube 32 so that fuel discharged from the injection orifice 36 flows into the mixing tube 32. Primary air to support combustion is obtained from the ambient space around the burner 10 (typically from below the burner 10) and is entrained by the fuel jet in conventional fashion through the open area around the inlet end of the primary mixing tube 32. Thus, the mixing tube 32 introduces a primary fuel-air mixture into the interior of the burner body 14.

A secondary mixing tube 38, such as a venturi tube, extends axially through the support surface 12 and the base portion 24 so as to have one end (the inlet end) located externally of the burner body 14, below the support surface 12, and the other end (the delivery end) located in the interior of the burner body 14. Alternatively, the delivery end may be flush with the base portion 24. The secondary mixing tube 38 is located adjacent to the primary mixing tube 32. As shown in the Figures, the secondary mixing tube 38 is at the first leg 18 of the burner body 14, although other locations are possible. A secondary fuel nozzle 40 is located approximately concentric with the secondary mixing tube 38 and has an injection orifice 42 aligned with the inlet end of the secondary mixing tube 38 so that fuel discharged from the injection orifice 42 flows into the secondary mixing tube 38. Primary air to support combustion is obtained from the ambient space around the burner 10 (typically from below the burner 10) and is entrained by the fuel jet in conventional fashion through the open area around the inlet end of the secondary mixing tube 38. Thus, the secondary mixing tube 38 introduces a secondary fuel-air mixture into the interior of the burner body 14.

A fuel flow divider 44 is disposed inside the burner body 14. The fuel flow divider 44 is shaped so as to direct fuel from the secondary mixing tube 38 to selected ports 30. In the illustrative embodiment, the fuel flow divider 44 is a delta-shaped member having first, second and third diffuser sections 46,48,50 for the primary fuel air mixture arranged around a center region. The first, second and third diffuser sections 46,48,50 of the fuel flow divider 44 are aligned with, but shorter than, the corresponding first, second and third legs 18,20,22 of the burner body 14. An inlet conduit 54 extends through the center of the. fuel flow divider 44 and is coaxially aligned with the primary mixing tube 32. Thus, the fuel-air mixture introduced via the primary mixing tube 32 is directed into the burner body interior surrounding the fuel flow divider 44, hereinafter referred to as the primary fuel chamber 56.

The fuel flow divider 44 also includes three C-shaped enclosures 58,60,62 formed between adjacent ones of the first, second and third diffuser sections 46,48,50. Each enclosure 58,60,62 extends above the upper surface of the fuel flow divider 44 into engagement with the underside of the cap 28. Each enclosure 58,60,62 includes a pair of laterally spaced ridges 64 that extend outward from the sides of the fuel flow divider 44 and are received in slots formed in the inner surface of the sidewall 26. Thus, each enclosure 58,60,62 cooperates with the base portion 24, the sidewall 26 and the cap 28 to define first, second and third secondary fuel chambers 66,68,70, respectively that are each isolated from the primary fuel chamber 56. Although three enclosures and three diffuser sections are shown by way of example, it should be understood that the number of these elements is not limited to three. Furthermore, it is not required that the number of enclosures and the number of diffuser sections be the same.

Each of the secondary fuel chambers 66,68,70 is in fluid communication with a corresponding one of the burner ports 30. However, it should be noted that each of the secondary fuel chambers 66,68,70 could be in fluid communication with more than one of the ports 30. The remaining burner ports 30 (i.e., any one of the ports 30 not in fluid communication with one of the secondary fuel chambers 66,68,70) are in fluid communication with the primary fuel chamber 56.

Figure 4:
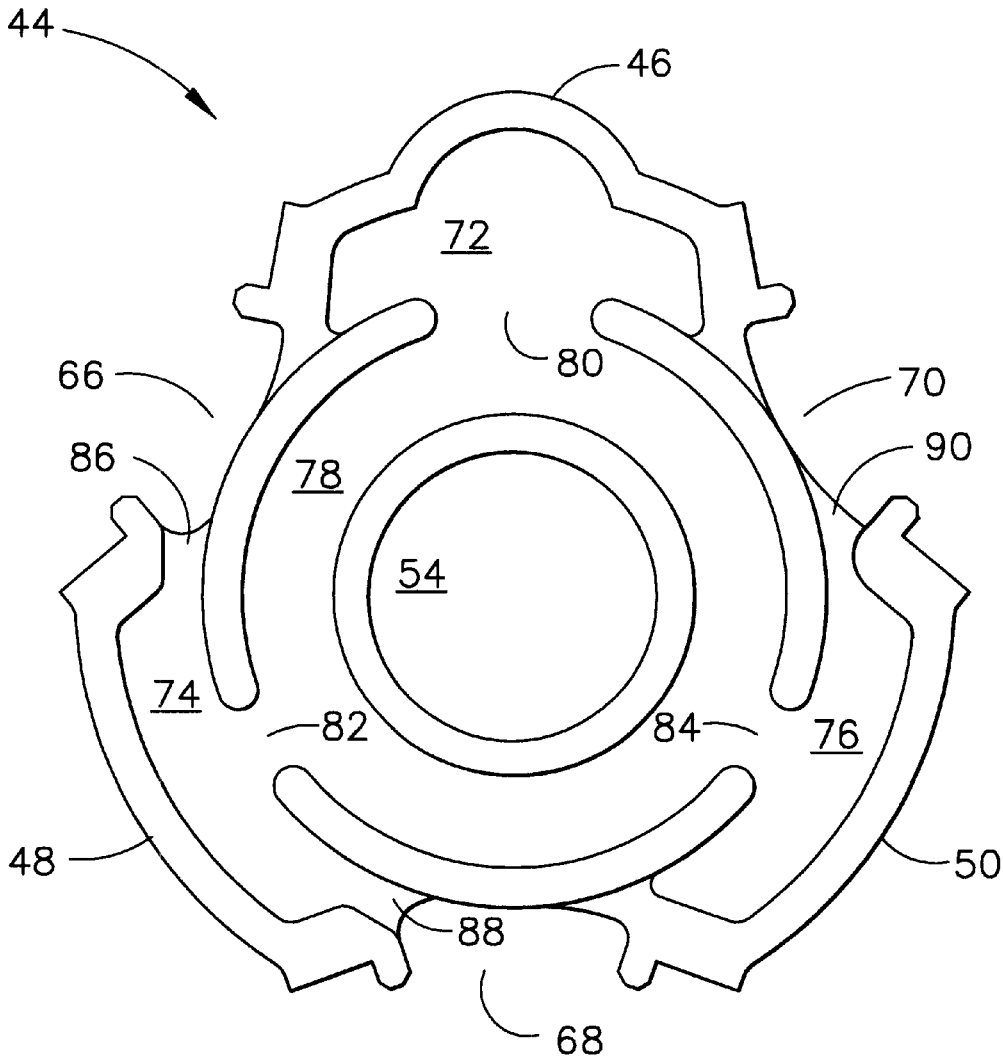
FIG. 4 is a bottom view of the fuel flow divider from the gas burner of FIG. 1.

As best seen in FIG. 4, the underside of the fuel flow divider 44 (i.e., the side facing the base portion 24) has a series of cavities and channels formed therein that define a passageway for directing the fuel-air mixture introduced via the secondary mixing tube 38 to the secondary fuel chambers 66,68,70. Specifically, first, second and third cavities 72,74,76 are formed the bottom side of the distal ends of the first, second and third diffuser sections 46,48,50, respectively. The delivery end of the secondary mixing tube 38 is located in the first cavity 72. An annular channel 78 encircles the inlet conduit 54, and first, second and third openings 80,82,84 provide fluid communication between the annular channel 78 and the first, second and third cavities 72,74,76, respectively. The second cavity 74 has two apertures 86 and 88 that provide fluid communication with the first and second secondary fuel chambers 66 and 68, respectively, and the third cavity 76 has an aperture 90 that provides fluid communication with the third secondary fuel chamber 70. Alternatively, the second secondary fuel chamber 68 could be provided with fuel via an aperture in the third cavity 76 instead of the second cavity 74.

Thus, the fuel flow divider 44 defines two distinct fuel flow circuits having no significant leakage therebetween. In the first circuit in which the primary fuel-air mixture flows from the primary mixing tube 32, through the inlet conduit 54, and into the primary fuel chamber 56. The upper surface of the fuel flow divider 44, which forms a gap with the cap 28, approximates a cylindrical diffuser for the fuel-air mixture. The primary fuel-air mixture is discharged through the burner ports 30 that are in fluid communication with the primary fuel chamber 56 (i.e., the primary ports) for combustion. Combustion is initiated by a conventional igniter, such as a spark ignition electrode (not shown), located adjacent to one of the burner ports 30.

In the second circuit, the secondary mixing tube 38 delivers the secondary fuel-air mixture into the first cavity 72. From there, the secondary fuel-air mixture flows through the first opening 80 into the annular channel 78 and then through the second and third openings 82 and 84 into the second and third cavities 74 and 76, respectively. The fuel-air mixture in the second cavity 74 passes through the first aperture 86 into the first secondary fuel chamber 66 and through the'second aperture 88 into the second secondary fuel chamber 68. The fuel-air mixture in the third cavity 76 passes through the third aperture 90 into the third secondary fuel chamber 70. The secondary fuel-air mixture from each secondary fuel chamber 66,68,70 is discharged through the corresponding burner port 30 that is in fluid communication therewith (i.e., the secondary ports) for combustion.

As shown in the Figures, there are twenty-seven primary ports and three secondary ports, thereby providing a 10:1 ratio of total burner ports to secondary ports. While the present invention is not necessarily limited to this port ratio, the number of secondary ports will be considerably less than the number of primary ports.

The primary fuel nozzle 34 is connected to a source of gas 92 via a first valve 94, and the secondary fuel nozzle 40 is connected to the source of gas 92 via a second valve 96 (shown schematically in FIG. 3). Both valves 94 and 96 are jointly controlled in a known manner by a control knob on the gas cooking appliance to regulate the flow of gas from the source 92 to the two fuel nozzles 34 and 40. The range of operation of the valves 94 and 96 is as follows. When the control knob is turned wide open, the first valve 94 supplies fuel at maximum pressure to the primary fuel nozzle 34, and the second valve 96 supplies fuel at maximum pressure to the secondary fuel nozzle 40. As the knob is turned down, the fuel pressure to the primary fuel nozzle 34 is gradually reduced until such point that a minimum pressure for a sustainable flame is reached. Over this range, the fuel supplied to the secondary fuel nozzle 40 from the second valve 96 can either be constant or vary as the knob is turned down. Upon further turndown from the above-mentioned point that a minimum pressure for a sustainable flame is reached, the first valve 94 remains closed so that no fuel is supplied to the primary fuel nozzle 34, and the fuel pressure to the secondary fuel nozzle 40 is gradually reduced until the burner 10 is turned off.

For regular operation, the valves 94 and 96 are adjusted by manipulating the control knob so that fuel is directed to the primary and secondary fuel nozzles 34 and 40. This fuel is discharged from the respective injection orifices 36 and 42, entrains air for combustion, and enters the corresponding mixing tubes 32 and 38. The fuel-air mixture from the primary mixing lube 32 flows through the inlet conduit 54 and into the primary fuel chamber 56. From there, the primary fuel-air mixture is discharged through the primary ports for combustion. The fuel-air mixture from the secondary mixing tube 38 flows into the first cavity 72 and follows the flow paths described above into the secondary fuel chambers 66,68,70. From there, the secondary fuel-air mixture is discharged through the secondary ports for combustion. Thus, all thirty burner ports 30 support a flame during regular operation.

For simmer or extended turndown operation, the control knob is adjusted so that fuel is directed to the secondary fuel nozzle 40 only. As before, this fuel is discharged from the secondary injection orifice 42, entrains air for combustion, and flows through the secondary mixing tube 38 into the first cavity 72. The secondary mixture than flows into the secondary fuel chambers 66,68,70 and is discharged through the secondary ports for combustion. Thus, during simmer operation only the three secondary ports support a flame. Accordingly, because the ratio of total burner ports to secondary ports is 10:1, the turndown ratio over the entire range of burner operation will be increased ten times over that turndown ratio available for regular operation. For example, if the gas burner 10 could support a turndown ratio of 10:1 during regular operation, then it would have a turndown ratio of 100:1 over its entire range of operation.

An ancillary benefit of the present invention is that the flames supported by the secondary ports (i.e., those of the ports 30 that are on the secondary fuel circuit) tend to be more resistant to transient disturbances, such as door slams, which tend to extinguish flames in conventional burners. This is because the secondary fuel chambers 66,68,70 and the cavities 74 and 76 act as flow disturbance dampers due to their relatively large volumes adjacent to the port and with restricted access to the supply circuit. Thus, the secondary port flames will be able to withstand transient disturbances that extinguish the primary port flames and will subsequently serve as a reignition source for the primary ports after the disturbance has passed. Additionally, the secondary ports are positioned in the burner body to make them less susceptible to drafts.

The foregoing has described a single body gas burner having an extended turndown ratio. While specific embodiments of the present invention have been described, it will be apparent to those skilled in the art that various modifications thereto can be made without departing from the spirit and scope of the invention as defined in the appended claims.

What is claimed is:

1. A gas burner comprising:

a burner body having center region with a plurality of legs radiating outward therefrom and having a plurality of ports formed therein;

a fuel flow divider having center region with a plurality of diffuser sections radiating outward therefrom, said fuel flow divider being disposed in said burner body so that each one of said diffuser sections is located in a corresponding one of said burner body legs, said fuel flow divider defining a primary fuel chamber and a plurality of secondary fuel chambers, wherein each one of said secondary fuel chambers is in fluid communication with a separate set of at least one of said plurality of ports and said primary fuel chamber is in fluid communication with the remaining ones of said plurality of ports;

a primary mixing tube for introducing a fuel-air mixture into said primary fuel chamber; and a secondary mixing tube for introducing a fuel-air mixture into said secondary fuel chambers.

2. The gas burner of claim 1 wherein said secondary fuel chambers are isolated from said primary fuel chamber.

3. The gas burner of claim 1 wherein said fuel flow divider includes a inlet conduit that is aligned with said primary mixing tube and is in fluid communication with said primary fuel chamber.

4. The gas burner of claim 3 wherein said fuel flow divider has a passageway formed in its underside, said passageway comprising:

a cavity formed in the distal end of each one of said diffuser sections, one end of said secondary mixing tube being located in a first one of said cavities;

an annular channel encircling said inlet conduit, said annular channel being in fluid communication with each one of said cavities;

a first aperture between a second one of said cavities and a first one of said secondary fuel chambers;

a second aperture between a second one of said cavities and a second one of said secondary fuel chambers; and a third aperture between a third one of said cavities and a third one of said secondary fuel chambers.

5. The gas burner of claim 4 wherein said inlet conduit is centered in said center region of said fuel flow divider.

6. The gas burner of claim 1 wherein said fuel flow divider includes a plurality of enclosures formed thereon, said enclosures cooperating with said burner body to define said secondary fuel chambers.

7. The gas burner of claim 6 wherein each one of said enclosures includes a pair of outwardly extending ridges that engage said burner body.

* * * * *